US005236368A

United States Patent [19]

Adams et al.

[11] Patent Number: 5,236,368

[45] Date of Patent: Aug. 17, 1993

[54] PRINTED CIRCUIT BOARD AND OUTRIGGER EDGE CONNECTOR ASSEMBLY AND METHOD OF ASSEMBLING THE SAME

[75] Inventors: Paul H. Adams, Danbury; Heinz Piorunneck, Trumbull; Rocco J. Noschese, Wilton, all of Conn.

[73] Assignee: Burndy Corporation, Norwalk, Conn.

[21] Appl. No.: 817,185

[22] Filed: Jan. 6, 1992

[51] Int. Cl.[5] ..... H01R 23/70

[52] U.S. Cl. ..... 439/79; 439/62

[58] Field of Search ..... 439/79, 59, 60, 62, 439/637, 636

[56] References Cited

U.S. PATENT DOCUMENTS

| | | | |
|---|---|---|---|
| 3,199,066 | 8/1965 | Eledge et al. | 439/636 |
| 4,298,237 | 11/1981 | Griffith et al. | 439/60 |
| 4,392,700 | 7/1983 | Showman et al. | 439/260 |
| 4,710,133 | 12/1987 | Lindeman | 439/62 |
| 4,806,110 | 2/1989 | Lindeman | 439/108 |
| 4,869,672 | 9/1989 | Andrews, Jr. | 439/60 |
| 4,907,975 | 3/1990 | Dranchak et al. | 439/67 |
| 4,932,888 | 6/1990 | Sensor | 439/108 |
| 4,934,961 | 6/1990 | Piorunneck et al. | 439/637 |
| 4,981,449 | 1/1991 | Buchter | 439/724 |
| 4,996,766 | 3/1991 | Piorunneck et al. | 29/842 |
| 5,024,609 | 6/1991 | Piorunneck | 439/637 |
| 5,041,023 | 8/1991 | Lytle | 439/637 |
| 5,127,839 | 7/1992 | Korsunsky et al. | 439/79 |

FOREIGN PATENT DOCUMENTS 2163305A 2/1986 United Kingdom .

OTHER PUBLICATIONS

IBM Technical Disclosure Bulletin, "High-Density Card Edge Connector", vol. 19, No. 2, 07-76.

*Primary Examiner*—Gary F. Paumen

*Attorney, Agent, or Firm*—Perman & Green

[57] ABSTRACT

An outrigger electrical connector includes a housing and electrical contacts. The housing is adapted to be fixedly connected to a side of a daughter printed circuit board between two rows of contact pads at a card edge connection area of the daughter printed circuit board. The housing has a downwardly extending ledge laterally spaced from the first side. The contacts have a top portion at a top of the housing at the housing first side and a bottom contact portion extending down along the housing ledge.

17 Claims, 6 Drawing Sheets

PRINTED CIRCUIT BOARD AND OUTRIGGER EDGE CONNECTOR ASSEMBLY AND METHOD OF ASSEMBLING THE SAME

BACKGROUND OF THE INVENTION

1. Field of the Invention

The present invention relates to electrical connectors and, more particularly, to an outrigger edge connector for use in connecting a daughter printed circuit board to a mother printed circuit board.

2. Prior Art

U.S. Pat. No. 4,932,888 to Senor discloses an electrical connector with a second housing that partially fits inside a first housing and has fingers to contact a side of a printed circuit board. U.S. Pat. No. 4,806,110 to Lindeman discloses a circuit board assembly with a connector fixedly attached to a circuit board. U.K. Patent Application 2163305 to Teradyne Inc. discloses an upper daughter board connector element fixedly connected to a daughter board that is inserted into a lower backplane connector element. U.S. Pat. No. 4,392,700 to Showman et al. discloses a cam actuated zero insertion force connector with a plug connector mounted on an edge of a daughter board that is inserted into a receptacle assembly. U.S. Pat. No. 4,869,672 to Andrews Jr. discloses a dual purpose card edge connector that can receive either of two different types of printed circuit boards. Other relevant art includes U.S. Pat. Nos. 4,981,449; 4,907,975; 5,024,609; 4,298,237; 4,996,766; and 4,934,961.

Problems exists in the art in that there is a need for a new system and method for connecting a daughter printed circuit board to a mother printed circuit board that has a relatively large number of contacts, can accept different types of daughter printed circuit boards, can be connected with different types of edge card socket connectors, and can do so in a limited amount of space.

SUMMARY OF THE INVENTION

The foregoing problems are overcome and other advantages are provided by a new and improved printed circuit board and outrigger edge connector assembly and method of assembling the same.

In accordance with one embodiment of the present invention, an outrigger connector for use with a daughter printed circuit board having a card edge connection area is provided. The outrigger connector generally comprises a housing and at least one electrical contact connected to the housing. The housing is comprised of a dielectric material and has a first side adapted to be fixedly connected to a side of the daughter printed circuit board between two rows of contact pads at the card edge connection area. The housing has a downwardly extending ledge laterally spaced from the first side. The electrical contact includes a top contact portion at a top of the housing at the housing first side and a bottom contact portion extending down along the housing ledge.

In accordance with another embodiment of the present invention, a daughter printed circuit board assembly is provided. The assembly comprises a first portion, a second portion, and means for connecting. The first portion has at least two rows of contact pads thereon. The second portion is fixedly connected to the first portion at an area above a bottom row of contact pads. The second portion has a housing and electrical contacts thereof. The means for connecting can connect at least some of the contact pads to either a first type of connector or a second type of connector. The means for connecting comprises an open area between a lower section of the first portion and a lower section of the second portion such that the lower section of the first portion can be received into a card edge receiving area of the first type of connector with the lower section of the second portion being located substantially outside of the first type of connector and, the lower sections of the first and second portions can both be received into card edge receiving areas of the second type of connector.

In accordance with another embodiment of the present invention, a card edge connector is provided for making electrical connection between a mother printed circuit board and a daughter printed circuit board. The connector comprises a housing, and at least four rows of contacts connected to the housing. The housing is comprised of dielectric material and has at least three parallel rows of card edge receiving slots. The at least four rows of contacts includes two of the rows being located at a center slot of the card edge receiving slots and adapted to contact a portion of a daughter printed circuit board inserted into the center slot.

In accordance with another embodiment of the present invention, a daughter printed circuit board assembly is provided. The assembly comprises a main body, and an outrigger. The main body has a card edge connection area. The outrigger is fixedly connected to the main body at the card edge connection area. The outrigger extends away from the main body and has a downwardly extending ledge parallel to, but spaced from, a bottom portion of the card edge connection area such that the contact areas on the bottom portion of the card edge connection area and contact areas on the ledge can make contact with a card edge connector in a substantially parallel simultaneously manner.

In accordance with one method of the present invention, a method of assembling a printed circuit board and connector outrigger assembly is provided. The method comprises steps of providing a printed circuit board of the card edge connection type having a main body portion, the main body portion including a card edge connection area and two rows of contact pads thereon; providing a connector outrigger with a housing and electrical contacts thereon; and fixedly connecting the outrigger to the main body portion at the card edge connection area, the outrigger being located above a bottom row of the contact pads at the main body portion, extending outwardly from the main body portion, and having a ledge extending down and parallel to a bottom portion of the main body portion.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
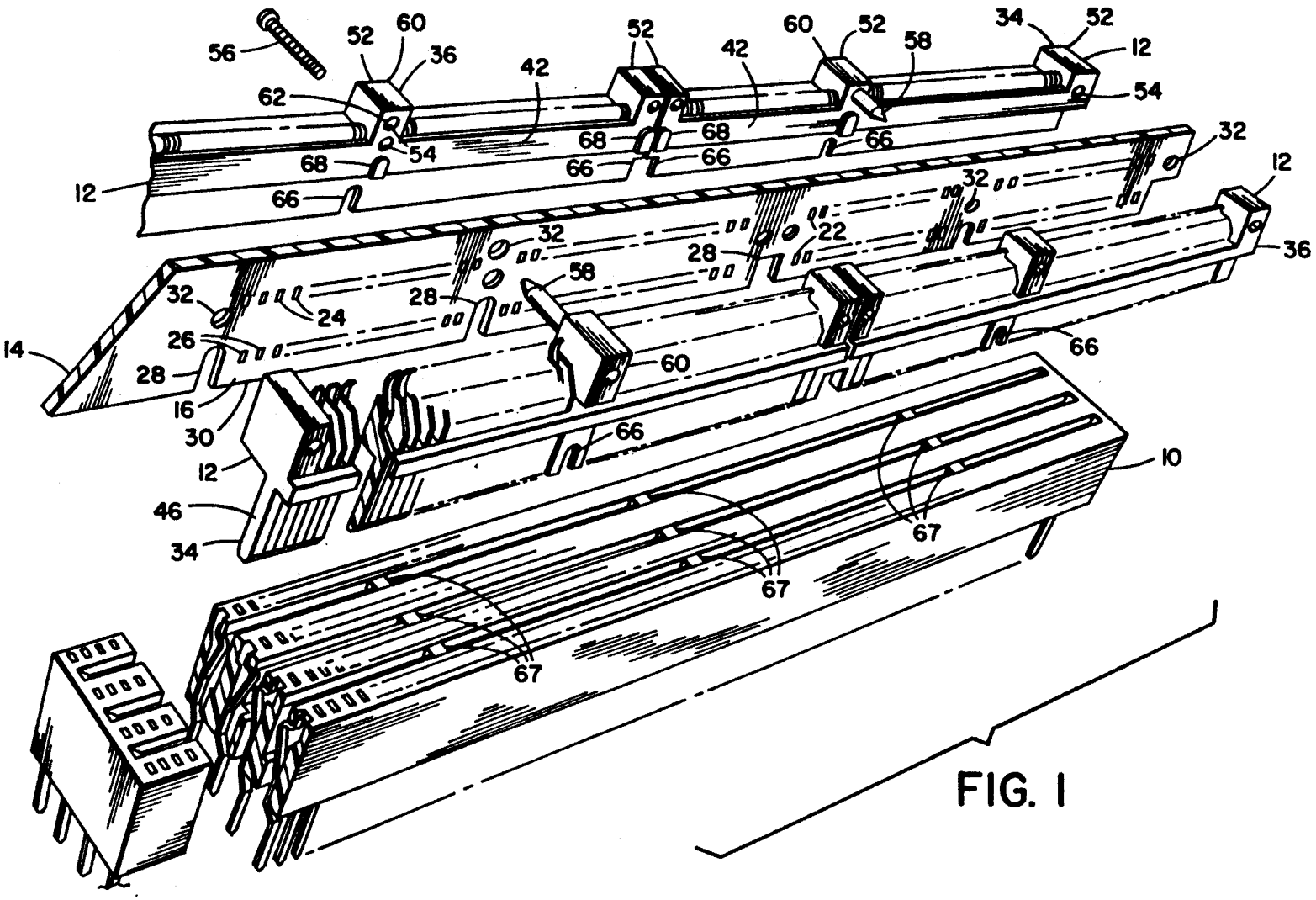
FIG. 1 an exploded perspective view of a card edge connection area of a printed circuit board, two outrigger connectors, and a card edge connector incorporating features of the present invention.

Referring to FIG. 1, there is shown an exploded perspective view of a system for making contact between a daughter printed circuit board and a mother printed circuit board. Although the present invention will be described with reference to the embodiments shown in the drawings, it should be understood that the present invention can be embodied in various different forms and embodiments. In addition, any suitable size, shape, or type of materials or elements can be used in various different types of embodiments of the invention.

Figure 2:
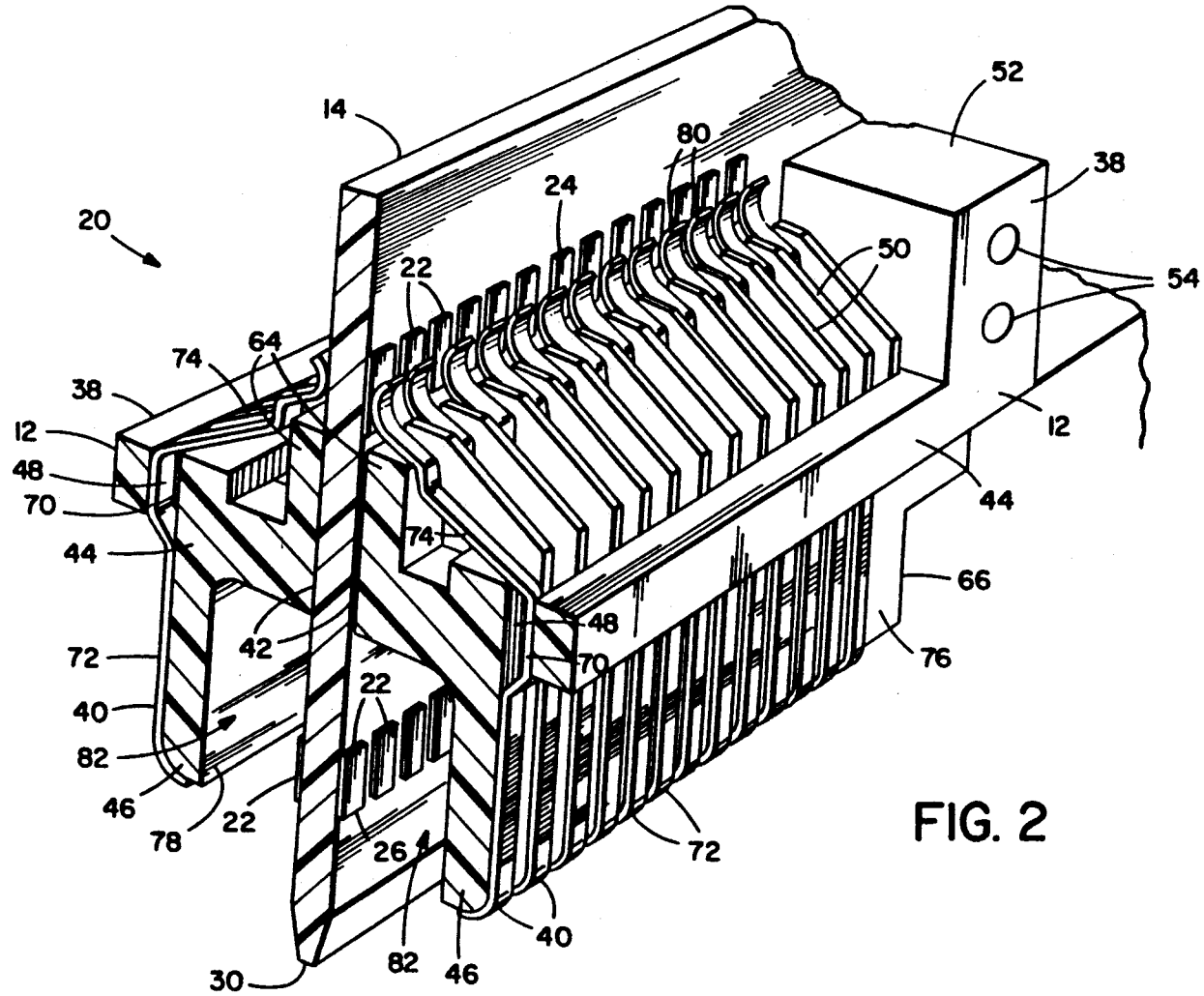
FIG. 2 is a partial perspective view with a cross sectional view of an assembly of the two outrigger connectors and daughter printed circuit board shown in FIG. 1.
Figure 4:
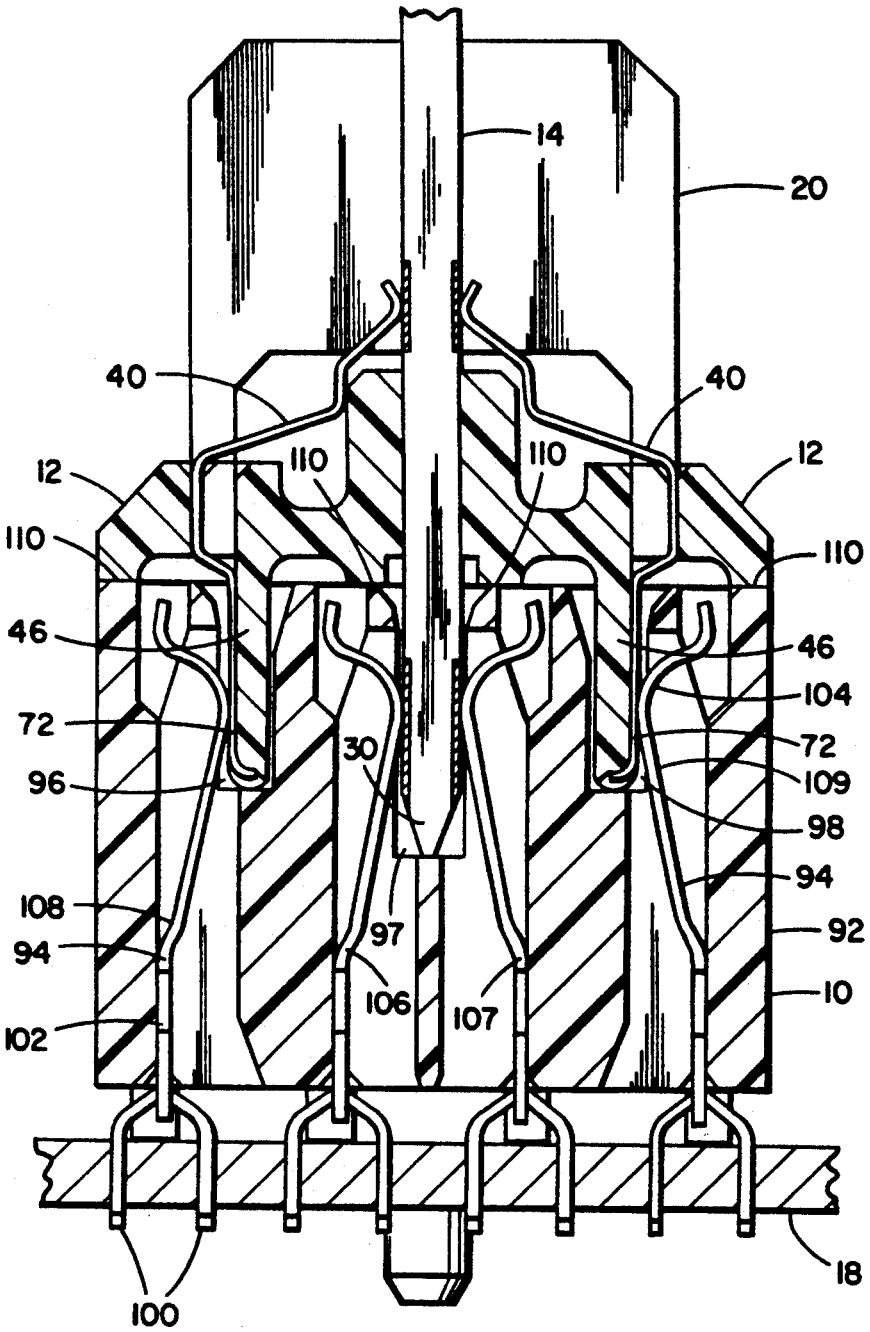
FIG. 4 is a schematic cross sectional view of the assembly shown in FIG. 2 connected to the second type of card edge connector shown in FIG. 1.

The system shown in FIG. 1 generally comprises a card edge connector 10, and outrigger connectors 12 to connect a daughter printed circuit board 14 (of which only a card edge connection area 16 is shown) to a mother printed circuit board 18 (see FIG. 4). The outrigger connectors 12 are fixedly connected to the card edge connection area 16 to form an assembly 20 as shown in FIG. 2. The daughter printed circuit board 14, in the embodiment shown, generally comprises two rows of contacts pads 22 on each side of the board 14; an upper row 24 and a lower row 26. The board 14 has slots 28 extending into the connection area 16 from its leading edge 30 and holes 32 located above the slots 28. The slots 28 are generally used to polarize insertion of the edge 30 into connector 10 as is known in the art and help properly position the edge 30 in the connector 10 such that contacts in the connector 10 are properly connected to respective pads 24 and 26 on the board 14. However, any suitable type of daughter board could be used as further understood from the description below.

Referring particularly to FIGS. 1 and 2, the assembly 20, in the embodiment shown, includes four outrigger connectors 12. However, any suitable number of outrigger connectors 12 could be provided such as one, two, three, or more than four. In the embodiment shown, two types of outrigger connectors are provided; a first type 34 and a second type 36. However, only one type, or more than two types, could be provided. Each outrigger connector 12 includes a housing 38 and a plurality of electrical contacts 40. The housings 38 are preferably comprised of a molded dielectric material. Each of the housings 38 include a first side 42 adapted to be positioned against a side of the daughter board 14 between the upper row of pads 24 and the lower row of pads 26. The housings 38 each also have a middle section 44 that extends away from the first side 42 and a ledge 46 that extends down from the middle section 44. The ledges 46 are laterally offset from the first sides 42 as shown. Each middle section 44 include a row of contact channels 48 such that the contacts can be fixedly attached to the housings 38 therein. Each housing 38 also includes divider walls 50 to help keep the contacts separated. The housings 38, in the embodiment shown, include blocks 52 at their ends and centers. The blocks 52 have holes 54 therein for receiving rivets 56. The first type of outrigger connectors 34, in the embodiment shown, have a pin section 58 extending from their first sides 42 at their center block 60. The second type of outrigger connectors 36 have holes 62 at their center block 60 for receiving the pin section 58. However, the pin sections 58 and the holes 62 need not be provided. In addition, any or all of the blocks 60 could have pin sections 58 and holes 62.

Each first side 42 of the housings 38 also include a preload section 64 such that the contacts 40 can be preloaded or prestressed against preload section 64 prior to connection of the outrigger connectors 12 to the daughter board 14 to obtain good contact with upper pads 24 when connection is made. However, preloading of the contacts 40 need not be provided. The first sides 42 of the housings 38 also have ridges 68 adapted to be located in the upper part of the daughter board slots 28. The daughter board 14 was originally designed to be inserted in a card edge receiving area having a single slot of a dual level card edge connector (not shown) having a larger height than the card edge connector 10. Thus, the ridges 68 occupy the upper space of the slots 28 that would otherwise be empty when connected to connector 10. This allows for a good seat of the assembly 20 on the polarizing ridges 67. The leading edge of the ledges 46 also have notches 66 to accommodate polarizing/location ridges 67 in the card edge connector 10.

The contacts 40 are generally comprised of an electrically conductive material, such as metal, and may have certain contact areas plated with good conductors, such as gold. Each contact has a center section 70, a bottom section 72, and a top section 74. Each center section 70 is fixedly connected to the housing 38 inside an individual contact channel 48. The bottom section 72 of each contact extends down along the outside 76 of ledge 46 and wraps partially around the bottom or leading edge of its ledge. However, in an alternate embodiment of the outrigger connectors, the contact bottom sections 72 could extend along the inside 78 of their ledges. In another alternate embodiment, the bottom section 72 need not wrap around the leading edge of the ledge. In one type of embodiment, suitable means can be provided to prevent movement of bottom sections 72 on their ledges. The top sections 74 are preloaded against preload sections 64 and have a curved tip 80 for contacting upper row pads 24. However, as noted above, the contacts 40 need not be preloaded and, the tip 80 need not be curved. In an alternate embodiment of the invention alternative means other than spring surface contact between contacts 40 and upper pads 24 could be provided, such as a through-hole contact. The top sections 74 are adapted to deflect in a spring contact fashion when the outrigger connector is attached to the daughter board 14.

In order to form the assembly 20, in the embodiment shown, a first type of outrigger connector 34 and a second type of outrigger connector 36 are located on opposite sides of the daughter board 14. The pin section 58 is positioned into an upper hole 32 of the daughter board and hole 62 of the second type of outrigger connector 36. The two outrigger connectors are pressed towards each other, sandwiching a portion of the board 14 therebetween. The rivets 56 are then inserted and attached to the outrigger connectors to fixedly and stationarily mount the two outrigger connectors on the sides of the daughter board 14. Of course, alternative or additional means for mounting the outrigger connectors to each other or the daughter board 14 could be provided. As can be seen in FIG. 2, with the outrigger connectors 12 attached to the daughter board 14, a space or open area 82 is formed on each side of the daughter board between a lower section of the daughter board 14 and a ledge 46. These open areas 82 are adapted to receive portions of card edge connectors such as a first type of connector 84 shown in FIG. 3 or the second type of connector 10 shown in FIG. 4. Of course, as described above, the daughter board 14 can be inserted into a third type of connector (not shown) when the outrigger connectors are not attached to the daughter board 14.

Figure 3:
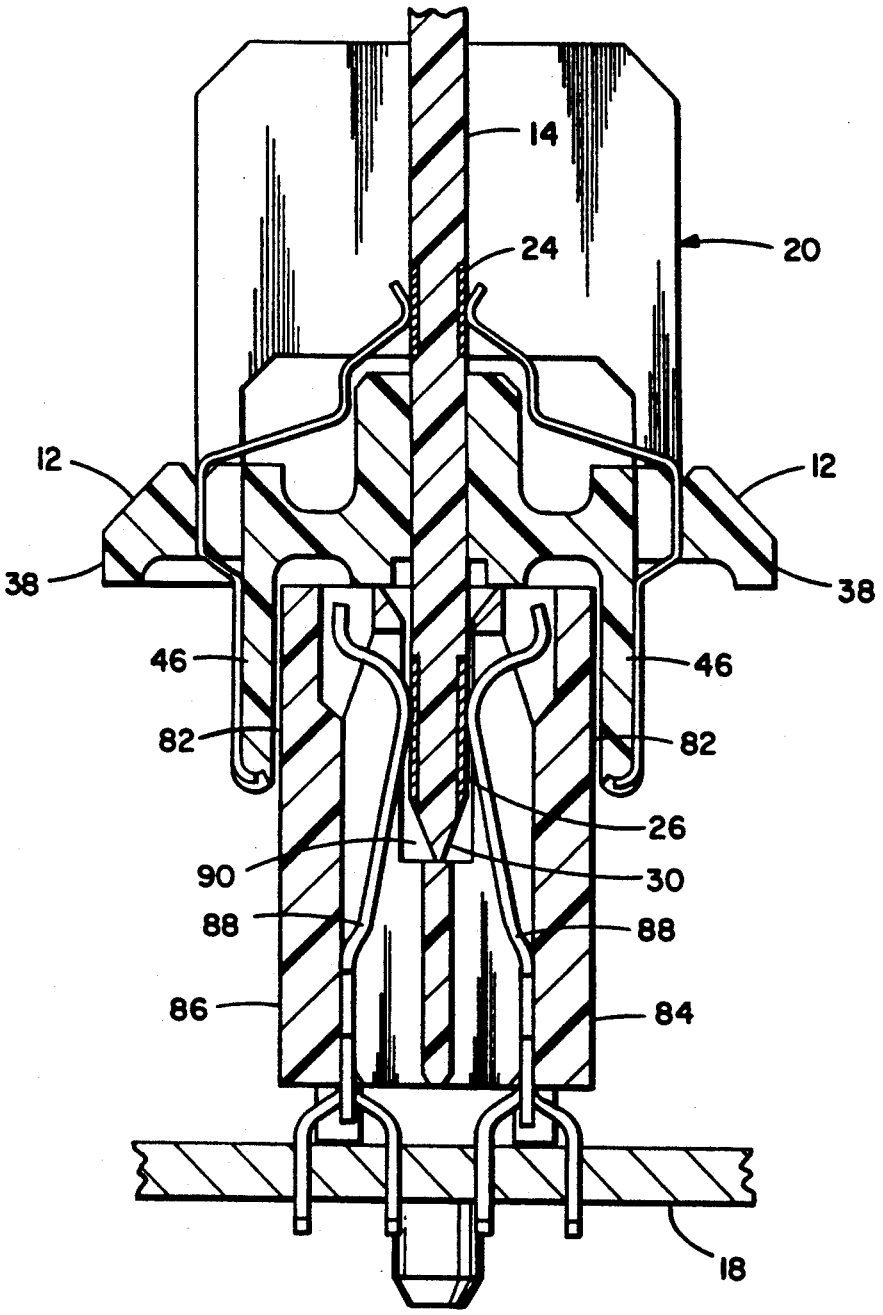
FIG. 3 is a schematic cross sectional view of the assembly shown in FIG. 2 connected to a first type of card edge connector.

Referring to FIG. 3, the assembly 20 is shown electrically and mechanically connected to the first type of card edge connector 84. A similar type of card edge connector is described in U.S. Pat. No. 5,041,023 which is incorporated by reference in its entirety. The connector 84 has a housing 86 and two rows of spring contacts 88 that extend into a card edge receiving area 90 of the housing 86. The connector 84 is fixedly mounted to the mother board 18 and has solder tails 94 of the contacts 88 electrically connected to the mother board 18. In an alternate embodiment, the solder tails may be provided as surface mount contact sections rather than the through-hole type shown. Connection of the assembly 20 to the connector 84 is substantially similar to connection of a daughter printed circuit board to the connector 84.

The leading edge 30 of the daughter board 14 is merely inserted into receiving slot 90 and wedges the contacts 88 apart. However, in addition to having the leading edge 30 stop upon reaching the bottom of slot 90, the bottom of the outrigger connector housings 38, in the open areas 82, contact the top of the housing 86. This helps to stabilize the assembly 20 on the first type of connector 84. As can be seen, the ledges 46 are located outside the connector 84. Therefore, although electrical connection is made between contacts 88 and the lower row of pads 26, electrical connection is not made between upper row of pads 24 and the first type of connector 84. However, the outrigger connectors 12 nonetheless allow connection of daughter board 14 to the first type of connector 84.

Referring to FIG. 4, the assembly 20 is shown electrically and mechanically connected to the second type of card edge connector 10. The second type of connector 10 has a housing 92 and spring contacts 94. The housing is preferably comprised of molded dielectric material and includes three slots 96, 97, 98. The center slot 97 is adapted to receive the lower portion of the daughter board 14. The other two slots 96 and 98 are adapted to receive the ledges 46. In the embodiment shown, the center slot 97 and its spring contacts 94 are substantially identical to a CEE card edge connector also known as a MICRO CHANNEL connector. MICRO CHANNEL is a registered trademark of International Business Machines Corporation of Armonk, N.Y. However, the center slot 97 and its spring contacts can have any suitable configuration including extended industry standard architecture (EISA), industry standard architecture (ISA), or any suitable type of architecture. The slot 97 may also be adapted to receive a plug rather than a connection edge of a daughter board as further described below. The spring contacts 94 each include a solder tail section 100, a middle section 102, and a top section 104. The solder tail sections 100 are electrically connected to the mother board 18. The middle sections 102 are fixedly connected to the housing 92. The top sections 104 are adapted to be deflected by the daughter board 14 and ledges 46 when inserted in slots 96, 97, 98. In the embodiment shown, the center slot 97 has two rows of contacts 106, 107 on opposite sides of the slot 97 to contact both sides of the daughter board 14. The other two slots 96, 98 each have one row of contacts 108 and 109, respectively. The two outer rows of contacts 108 and 109 are both adapted to make contact with the bottom sections 72 of the contacts 40 when the ledges 46 are located in the slots 96 and 98. Since the contacts 40 are connected to the upper row of pads 24, and the contacts 94 are connected to the contacts 40 and the mother board 18, the upper row of pads 24 are thus connected to the mother board 18.

Connection of the assembly 20 to the second type of connector 10 merely comprises inserting the ledges 46 and lower portion of the daughter board 14 into the slots 96, 97, 98. This displaces or wedges the contacts 94 from home positions to their connection positions shown in FIG. 4. Insertion is stopped by contact of the leading edges of the daughter board and ledges with the bottoms of their respective slots, contact of the ridges 42 (see FIG. 1) with polarizing ridges 67, and contact of outrigger connector stop surfaces 110 with the top surface of the connector 10. However, the outer stop surfaces 110 need not be provided. In the embodiment shown, the leading edge 30 of the daughter board 14 is longer than the ledges 46. This allows the center two rows of contacts 94 to be deflected prior to the outer two rows of contacts. This stepped method of deflection allows easier connection of the assembly 20 to the connector 10. Center slot 97 is deeper than outer slots 96, 98 to accommodate the relatively longer daughter board lower section. However, in alternate embodiments, the slots 96–98 may have the same depth or, the center slot 97 could have a shallower depth than the outer slots 96 and 98. Of course, the multistep method of deflection need not be provided either. In the embodiment shown, the lower level of contact pads 26 on the bottom portion of the card edge connection area and the contact areas on the ledges 46 make electrical contact with the contacts 94 of the second type of card edge connector 10 in a substantially parallel simultaneous manner.

Figure 5:
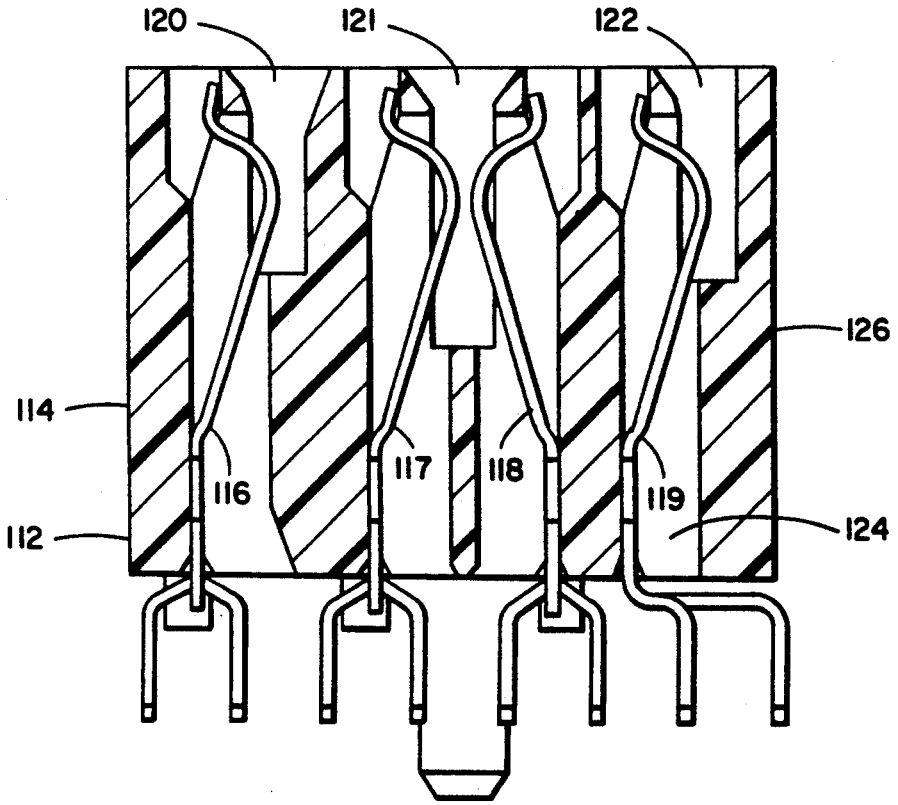
FIG. 5 is a cross sectional view of an alternate embodiment of a second type of card edge connector.

Referring now to FIG. 5, there is shown an alternate embodiment of a card edge connector 112. In the embodiment shown, the connector 112 includes a housing 114 and four rows of contacts 116, 117, 118, 119. The housing 114 is similar to the housing 92 shown in the embodiment in FIG. 4 in that it comprises three parallel slots 120, 121, 122 extending into the housing 114 from its top. However, in the embodiment shown in FIG. 5, the right side slot 122 and its contact receiving area 124 are substantially the same as the left side of the housing 114, rather than being a mirror image. The right row of contacts 119 project towards the lateral right side 126 of the housing rather than towards the longitudinal center of the housing 114. This embodiment illustrates that the card edge connector contacts need not be solely biased towards the longitudinal center of the housing. Such a configuration would include the situation where the contacts 40 (see FIG. 2) of the outrigger connectors extended along the inside 78 of the ledges 46. However, any suitable type of configuration could be provided. In addition, the outer slots 120 and 122 need not have merely one row of contacts, but may each have two or more rows of contacts. The center slot 121 may also have more than two rows of contacts.

Figure 6:
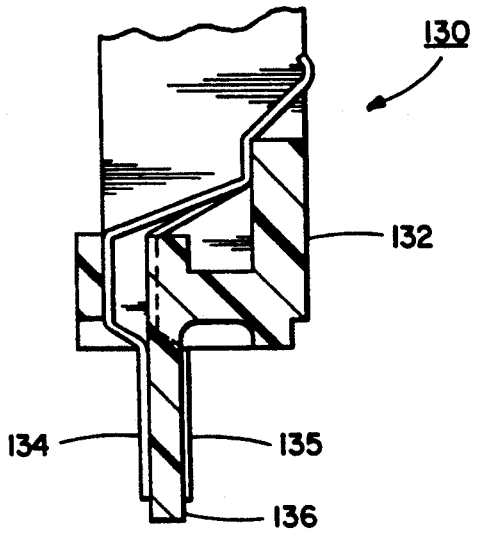
FIG. 6 is a partial cross sectional view of an alternate embodiment of the outrigger connector of the present invention.

Referring now to FIG. 6, there is shown an alternate embodiment of an outrigger connector 130. The connector 130 is substantially similar to connector 12 shown in FIG. 4. However, the connector housing 132 does not have an outer extension with a stop surface and, the connector 130 has contacts 134 and 135 that extend along both the inside and outside of the ledge 136. This type of outrigger connector can be used with a card edge connector having outer slots with two rows of contacts on opposite sides of the outer slot.

Figure 7:
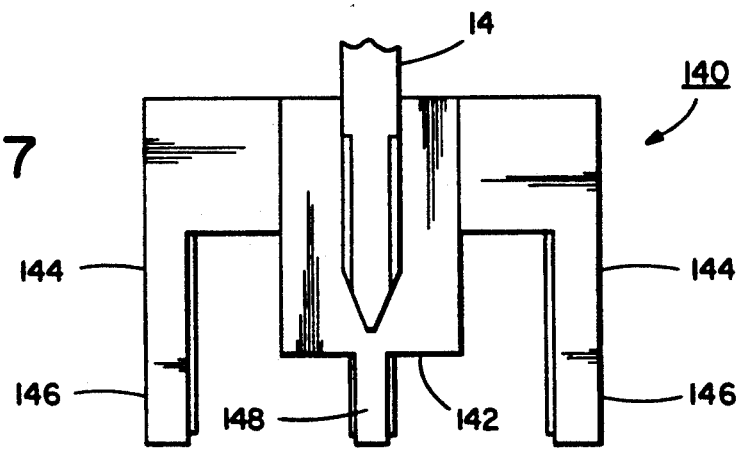
FIG. 7 is a schematic view of an alternate embodiment of the present invention.

Referring to FIG. 7, another alternate embodiment of the present invention is shown in a schematic view. The assembly 140 has a daughter board 14 with a plug 142 attached to it. These types of plugs are generally known in the art as shown by U.S. Pat. No. 4,710,133. In the embodiment shown, the outrigger connectors 144 are connected to the plug 142. Thus, as can be seen, the outrigger connectors need not be connected directly to the daughter board. The plug 142 is fixedly connected to the main body 14 of the assembly 140 at its card edge connection area. The outrigger connectors 144 are fixedly connected to the plug connector 142 with ledges 146 spaced from, but parallel to, the bottom portion 148 of the plug connector 142.

Figure 8:
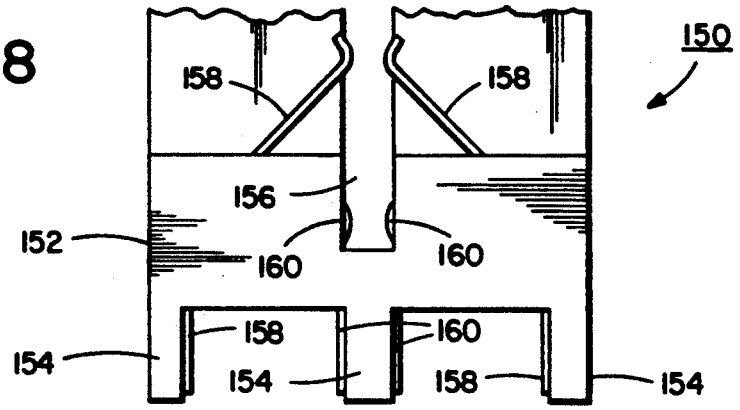
FIG. 8 is a schematic view of an alternate embodiment of the present invention.

Referring to FIG. 8, another alternate embodiment of the present invention is shown. In the embodiment shown, the outrigger connector 150 has a single housing 152 with three downward extending ledges 154 and a daughter board receiving slot 156. Contacts 158 extend along the outer ledges 154 and contacts 160 extend along the inner ledge 154. Thus, even if it is desired to contact pads on both sides of a daughter board, only one outrigger connector need be necessary.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An outrigger connector for use with a daughter printed circuit board having a card edge connection area, the outrigger connector comprising:

a housing comprised of a dielectric material, the housing having a first side adapted to be fixedly connected to a side of the daughter printed circuit board between a lower row and an upper row of contact pads at the card edge connection area, the housing having a downwardly extending ledge laterally spaced from the first side, the housing being suitably shaped to be spaced from the lower row of contact pads to establish an open area between the ledge and the lower row of contact pads adapted to receive a portion of a card edge connector; and at least one electrical contact connected to the housing, the contact including a top contact portion at a top of the housing at the housing first side and at least one bottom contact portion extending down along the housing ledge.

2. An outrigger connector as in claim 1 wherein the ledge comprises a suitable size and shape to be inserted into a receiving slot of the card edge connector.

3. An outrigger connector as in claim 1 wherein the electrical contact top contact portion is adapted to electrically contact an upper contact pad at the card edge connection area of the daughter printed circuit board.

4. An outrigger connector as in claim 1 further comprising means for fixedly connecting the housing to the daughter printed circuit board.

5. An outrigger connector as in claim 1 wherein the outrigger connector includes a plurality of separate electrical contacts aligned in a row.

6. An outrigger connector as in claim 1 wherein the outrigger connector includes at least two said housings adapted to be connected to each other with a portion of the daughter printed circuit board sandwiched therebetween.

7. An outrigger connector as in claim 1 wherein the connector comprises at least two contacts with the bottom contact portion of one contact extending along an outside of the housing ledge and the bottom contact portion of the other contact extending along an inside of the housing ledge.

8. An outrigger connector as in claim 1 wherein the housing includes means to preload the top contact portion of the contact.

9. A daughter printed circuit board assembly comprising:

a first portion having at least two rows of contact pads thereon;

a second portion fixedly connected to the first portion at an area above a bottom row of the contact pads, the second portion having a housing and electrical contacts thereon; and means for connecting at least some of the contact pads to either a first type of connector or a second type of connector, the means for connecting comprising an open area between a lower section of the first portion and a lower section of the second portion such that the lower section of the first portion can be received into a card edge receiving area of the first type of connector with the lower section of the second portion being located substantially outside of the first type of connector and, the lower sections of the first and second portions can both be received into receiving areas of the second type of connector.

10. An assembly as in claim 9 wherein the second portion housing has a first side adjacent the first portion between the two rows of contact pads and, the lower section of the second portion includes a ledge of the housing laterally spaced from the first side and extending parallel to the lower section of the first portion.

11. An assembly as in claim 9 further comprising a third portion fixedly connected to the first portion at an area above a bottom row of the contact pads on an opposite side of the first portion than the second portion, the third portion having a housing and electrical contacts thereon and being a substantial mirror image of the second portion.

12. An assembly as in claim 9 wherein the electrical contacts each have a top portion that electrically contacts a contact pad on an upper row of the at least two rows of contact pads and, a bottom portion along the second portion lower section adapted to make contact with a contact of the second type of connector.

13. A daughter printed circuit board assembly comprising:

a main body having a card edge connection area; and an outrigger fixedly connected to the main body at the card edge connection area, the outrigger extending away from the main body and having a downwardly extending ledge parallel to, but spaced from, a bottom portion of the card edge connection area such that electrical contact areas on the bottom portion of the card edge connection area and electrical contact areas on the ledge can make contact with a card edge connector in a substantially parallel simultaneous manner.

14. An assembly as in claim 13 wherein the outrigger comprises at least two ledges located on opposite sides of the card edge connection area.

15. An assembly as in claim 13 wherein the outrigger has electrical contacts connected to upper contact pads on the card edge connection area that extend along the ledge.

16. An assembly as in claim 13 wherein a space is provided between the card edge connection area and the ledge suitably sized and shaped to receive a portion of a card edge connector when the assembly is connected thereto.

17. A method of assembling a printed circuit board and connector outrigger assembly comprising steps of:

providing a printed circuit board of the card edge connection type having a main body portion, the main body portion including a card edge connection area with two rows of contact pads thereon;

providing a connector outrigger with a housing and electrical contacts thereon; and fixedly connecting the outrigger housing to the main body portion at the card edge connection area, the outrigger housing being connected to the card edge connection area above a bottom row of the contact pads at the main body portion, extending outwardly from the main body portion, having a ledge extending down and parallel to a bottom portion of the main body portion, and forming an open area between the bottom row of the contact pads and the ledge adapted to receive a portion of a card edge connector when a lower portion of the card edge connection area is inserted into a receiving slot of the card edge connector.

* * * * *